United States Patent [19]

Hill

[11] Patent Number: 4,473,244

[45] Date of Patent: Sep. 25, 1984

[54] FREEZE RESISTANT HOSE BIB RECEPTACLE

[76] Inventor: Edward L. Hill, P.O. Box 1028, Bellevue, Wash. 98009

[21] Appl. No.: 390,841

[22] Filed: Jun. 22, 1982

[51] Int. Cl.[3] ..... F16L 55/00; F16L 5/00

[52] U.S. Cl. ..... 285/14; 285/46; 137/360; 137/375

[58] Field of Search ..... 285/48, 46, 14; 137/360, 359, 375

[56] References Cited

U.S. PATENT DOCUMENTS

| | | | |
|---|---|---|---|
| 536,801 | 4/1895 | Gaghan | 137/360 X |
| 2,708,499 | 5/1955 | Keithley . | |
| 3,278,201 | 10/1966 | Noland . | |
| 4,158,366 | 6/1979 | Van Meter | 137/360 X |
| 4,286,616 | 9/1981 | Botnick | 137/360 X |
| 4,314,580 | 2/1982 | Steinwand | 137/360 |

*Primary Examiner*—Richard J. Scanlan, Jr.

[57] ABSTRACT

A receptacle for installation in exterior walls of a building for removable installation of a freeze resistant hose bib is shown. The receptacle comprises a tubular element having at one end means to receive and hold a threaded water supply pipe nipple in a clamping relationship with the threaded nipple end thereof inserted axially into the interior of the tube, and at the other end thereof a mounting block means adapted to be secured to exterior wall surface of a building. The tubular element extends into the wall and is adapted to receive through said block after installation in the wall a freeze resistant hose bib. The receptacle is fastened to the exterior wall surface and clamps the water supply pipe permitting subsequent installation and removal of a freeze resistant hose bib for servicing.

3 Claims, 2 Drawing Figures

10
12
14
15
16
18
20
22
23
24
26
28
30
32
34
36
38
40
42
44
46
48
49
50
52
α

FREEZE RESISTANT HOSE BIB RECEPTACLE

BACKGROUND OF THE INVENTION

This invention relates to plumbing apparatus, more particularly to hose bib cock assemblies comprising entire water flow control valve mechanisms including seal and valve seats, and hereinafter called hose bibs or sill cocks which are placed on the exterior of buildings.

In current installation techniques of freeze resistant hose bibs or sill cocks it is a common occurrance to have the pipe twist off inside the wall as the hose bib is removed for servicing or for the installation of siding material.

It is necessary by its nature to install the hose bib or sill cock in the wall prior to finishing to permit access to the location for connecting the hose bib to the supply pipe. Frequently after completion of various stages of construction it is necessary to remove the hose bib for one reason or another, including installation of siding and occasionally for servicing of the hose bib itself for removal of rocks, stones and other debris which flows through the plumbing system of a house under construction or simply for maintenance of the hose bib valve mechanism. Unless the supply pipe remains in perfect alignment with the aperature through which the hose bib is inserted difficulties will arise in the reinstallation of the hose bib, frequently necessitating removal of some wall board or siding adjacent the hose bib so that the supply pipe can be reunited with the hose bib. The reinstallation of the hose bib "blind" also ocasionally results in cross threading of the interconection between the hose bib and the supply pipe, not infrequently resulting in leaks within the walls.

OBJECTS OF THE INVENTION

It is an object of this invention to provide a permanently mounted receptacle for a freeze resistant hose bib which permits ready removal of the hose bib for siding installation and hose bib maintenance.

Another object of this invention is to provide a receptacle means for a freeze resistant hose bib which facilitates installation of siding.

It is a still further object of this invention to prevent leaks in the interconnection between hose bibs and supply pipes, and further to provide a conduit means to conduct any inadvertent leakage which may occur to a location outside the wall of the structure.

SUMMARY

These and other objects of this invention which will become apparent from a reading of the description following are accomplished by providing a hose bib receptacle which comprises an elongated tube attached to a flange means or mounting block at a slight angle from the horizontal. The tube is adapted to be installed into the wall of a house or other building with the terminal end of the tube receiving the water supply pipe axially. Supply pipe clamping means are provided at the terminal end of the tube to firmly grip the supply pipe and securely position it to axially within the tube. The tube is sized to receive the elongated tubular portion of a freeze resistant hose bib or sill cock axially in a position substantially coaxial with the water supply pipe. A threaded end on the water supply pipe is interconnected to a complementory threaded end of the freeze resistant hose bib and united therewith. The installation of the hose bib may then take place from the exterior of the building in which the receptacle is mounted by axial insertion of the tubular end of the hose bib into the portion of the receptacle extending into the wall of the building. The bib is then rotated to threadingly engage the threaded end of the water supply pipe. When the joint between the hose bib and the supply pipe is secured the hose bib is fastened to the block-like exterior portion of the receptacle with suitable fasteners.

The receptacle is provided with a weep hole permitting egress of any water which may escape from the joint between the water supply pipe and the hose bib to the exterior of the building. The tubular portion of the receptacle is angled slightly with respect to the securing block portion to facilitate drainage.

DETAILED DESCRIPTION OF THE PREFERRED EMBODIMENT

Figures 1, 2:
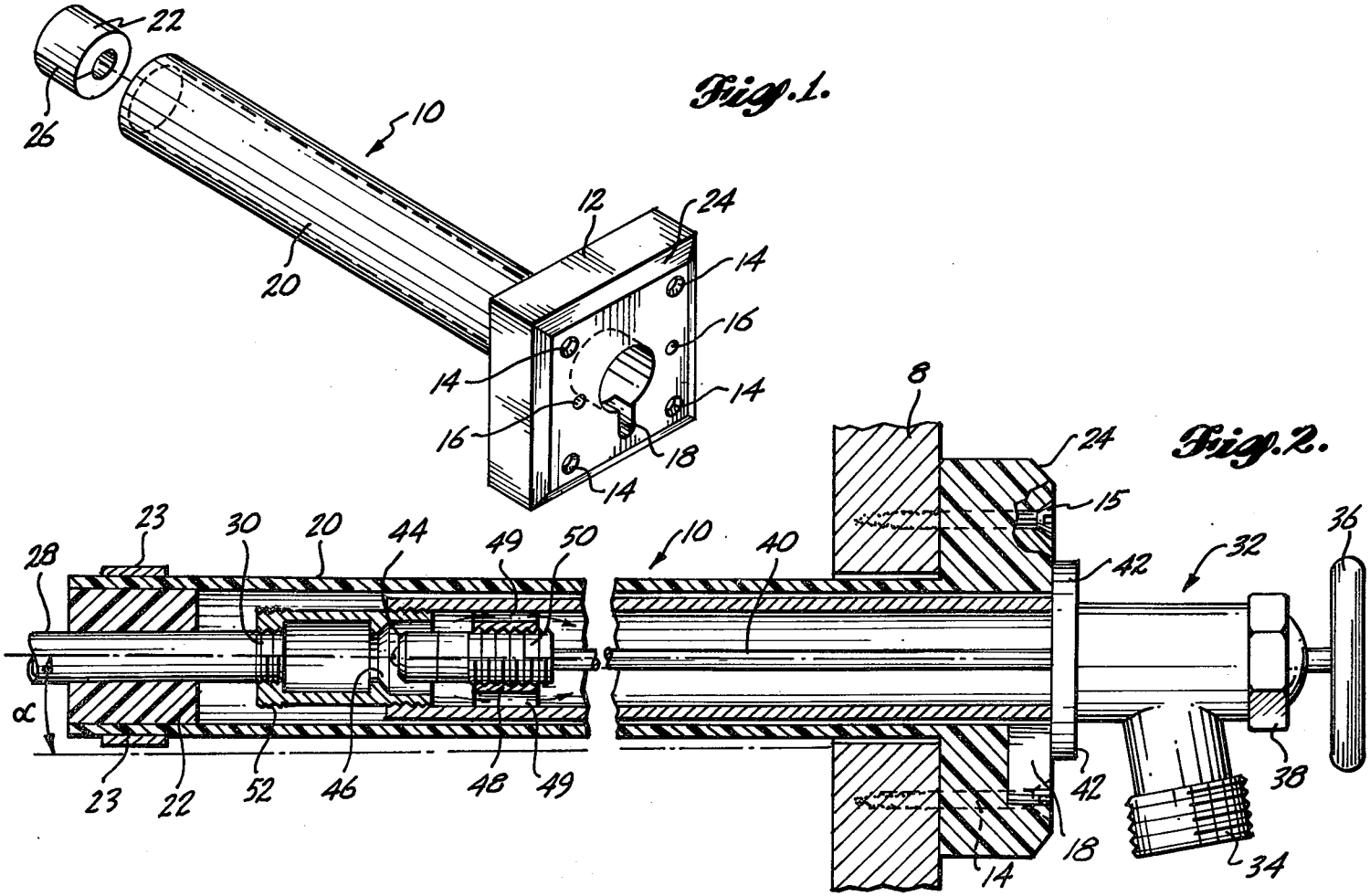
FIG. 1 is a perspective view of the device of this invention.
FIG. 2 is a side elevational view partly in section showing the device of FIG. 1 with a freeze resistant hose bib installed therein.

Referring now to the drawings wherein like numerals indicate like parts, there is seen in FIG. 1 a freeze resistant hose bib receptacle designed to be installed in an exterior wall of a building. A flange means comprising rectangular block 12 is shown attached to an elongated tubular element 20. Block 12 has a plurality of apertures 14 positioned in the corners thereof for receiving fastener means such as screws or nails used to attach the hose bib receptacle to a structural element of the building. Aperture 16 is provided for use in fastening a hose bib firmly to the receptacle after installation. Weep hole 18 extends part way through the block 12 to permit egress of any water which may accumulate or leak from an improperly installed bib or in the event a severe freeze overcomes the freeze resistant characteristics of the device and causes a leak in the system. Tube 20 is attached at an angle $\alpha$ from the horizontal as is best seen in FIG. 2. The slight upward angle $\alpha$ promotes drainage of any water which may be encountered in the installation thereby avoiding leakage within the walls which may damage the structure. Preferably, angle $\alpha$ is in the range of about 1° to about 10° from the horizontal.

The edges of block 12 are chamfered at 24 to enhance the appearance of the exterior of the receptacle.

Positioned at the terminal end of tube 20 is an interiorally disposed cylindrical seal and alignment ring 22. As best seen in FIG. 1, alignment ring 22 has a split 26 along its length permitting the alignment ring 22 to be spread to encircle the water supply pipe. In FIG. 2 the alignment ring 22 is shown in its operative position about the supply pipe 28. Alternately, if alignment ring 22 is made of a relatively hard and inflexible material, it may be provided in two segments to facilitate installation about the supply pipe. In some installations it may be possible to use a cylindrical seal and alignment means 22 which has no slit along its length but is installed by axially sliding the ring 22 into its position as shown in FIG. 2 along supply pipe 28.

A metal tightening band 23 is provided as shown in FIG. 2 to firmly tighten the terminal end of tube 20 about cylindrical seal and alignment ring 22. Such tightening means in the form of elongated bands having screw thread operators are well-known in the art. Since tube 20 must deform slightly in order to grip the cylindrical seal and alignment ring 22 it may occasionally be necessary to split tube 20 along a short distance of its length from its terminal end in order to facilitate gripping of the cylindrical seal and alingment ring 22. Tube 20 can be cut to various lengths to accommodate various wall thicknesses and hose bib dimensions.

The threaded portion 30 of supply pipe 28 is positioned as shown in FIG. 2 a substantial distance from wall 8 so that the freeze resistant characteristics of hose bib 32 may be utilized. Hose bib 32 is of a standard well-known construction in which the valve mechanism is positioned within the wall and an operator rod 40 extends outwardly to actuator 36 through bonnet 38. Well-known seal mechanisms are utilized in bonnet 38 to permit rotation of rod 40 without leakage. Rod 40 is connected to threaded section 50 which engages female threads 48 cut into the interior of the body of hose bib 32. Positioned adjacent the threaded section 48 of the valve body is valve seat 46. Valve seat 46 cooperates with replaceable seal 44 to serve as a water shutoff or valving mechanism. Water flows around threaded section 48 and 50 through passageways 49. Alternate well-known globe-type valve mechanisms similar in operation to that described above may be substituted. At the innermost end of hose bib 32 a threaded section is provided to receive the threaded end 30 of supply pipe 28. The particular bib shown also has exterior threads 52 which may be used to adapt the bib to larger pipe sizes.

INSTALLATION AND OPERATION

The device of this invention is usually installed in a house or other building under construction or may be retrofitted into existing buildings where a frost resistant hose bib installation is desired. The water supply pipe 28 is first located at the area in which the installation is to take place. The end is provided with threads and the cylindrical seal and alignment ring 22 is positioned on the supply pipe 28 at the proper distance from the end thereof to locate the supply pipe at the desired location within the hose bib receptacle. The exposed end with threads 30 of supply pipe 28 is then inserted into the end of tube 20 and located at the desired location within the tube 20. Band 23 is then securely tightened about the tube 20 and the receptacle located and fastened securely to the stuctural member 8. At any time thereafter the hose bib 32 may be installed by simply inserting it axially into the receptacle and rotating the bib until the threading engagement with supply pipe 28 is secure. The external portion 12 of receptacle 10 then forms a permanent fixture on the side of the building against which siding or other trim materials may be placed. The structure as described eliminates the need to adjust the hose bib after the siding has been completed. The hose bib is located at a proper distance from the side of the wall to permit easy installation of the hose on the threaded area 34.

Receptacle 10 is preferably constructed of an injectable plastic such as ABS (acrylonitrile-butadiene-styrene) or polyvinyl chloride. Other materials including metals and other well-known building materials may be substituted as desired.

In compliance with the statute the invention has been described in language more or less specific as to structural features. It is to be understood, however, that the invention is not limited to the specific features shown since the means and the construction herein disclosed comprise a prefered form of puting the invention into effect. The invention is, therefore, claimed in any of its forms or modifications within the legitimate and valid scope of the apended claims appropriately interpreted in accordance with the doctrine of equivilence.

I claim:

1. A receptacle for a freeze resistant hose bib adapted to threadingly engage a water supply pipe comprising:

flange means adapted to be secured to an exterior wall of a building, said flange means having an aperture therethrough to receive said freeze resistant hose bib;

an elongated tubular element substantially coaxial with said aperture connected to and extending substantially perpendicularly from said flange means to a terminal end;

a cylindrical seal and alignment ring sized to slide within and engage the interior of said tubular element at said terminal end, said cylindrical seal and alignment ring having a bore therethrough sized to receive and grip the exterior of said water supply pipe to position said pipe with a threaded end thereof axially within said tubular element in a position accessible for threading engagement with said freeze resistant hose bib when said hose bib is axially inserted through said aperture into said tubular element; and means to secure said cylindrical seal and alignment ring within said tubular element, whereby the entire hose bib may be removed from and reinstalled in said receptacle by said threading engagement.

2. The apparatus of claim 1 wherein said tube is angled slightly with respect to said flange to permit ready drainage of water through said aperture.

3. The apparatus of claim 1 wherein a weep hole means is provided in said flange to permit egress of water from said tube.

* * * * *